US009463901B2

(12) United States Patent
Raistrick et al.

(10) Patent No.: US 9,463,901 B2
(45) Date of Patent: Oct. 11, 2016

(54) AUXILIARY PRESCRIPTION LABEL

(71) Applicant: En-Vision America, Inc., Normal, IL (US)

(72) Inventors: David Raistrick, Bloomington, IL (US); Philip C. Raistrick, Normal, IL (US); Craig S. Raistrick, Bloomington, IL (US)

(73) Assignee: EN-VISION AMERICA, INC., Normal, IL (US)

( * ) Notice: Subject to any disclaimer, the term of this patent is extended or adjusted under 35 U.S.C. 154(b) by 271 days.

(21) Appl. No.: 14/077,790

(22) Filed: Nov. 12, 2013

(65) Prior Publication Data

US 2015/0021223 A1 Jan. 22, 2015

Related U.S. Application Data

(63) Continuation-in-part of application No. 13/943,222, filed on Jul. 16, 2013, now abandoned.

(51) Int. Cl.
*B65D 83/04* (2006.01)
*B65D 23/14* (2006.01)
(Continued)

(52) U.S. Cl.
CPC ..... *B65D 23/14* (2013.01); *B42D 3/18* (2013.01); *B65D 25/205* (2013.01)

(58) Field of Classification Search
CPC .. B65D 25/20; B65D 25/205; B65D 25/106; B65D 25/103; B65D 25/105; B65D 25/10; B65D 23/14; B65D 23/12; Y10S 283/90
USPC ..... 206/528, 534, 232; 281/26, 29, 9, 49, 281/50; 283/61, 62, 63.1, 64, 900; 40/310, 40/359, 360, 638; 24/67 P, 67 AR, 68 R, 24/16 R, 17 R, 16 PB
See application file for complete search history.

(56) References Cited

U.S. PATENT DOCUMENTS 1,280,790 A * 10/1918 McMann ..... B42D 3/002 281/21.1
4,208,983 A 6/1980 Buckley
(Continued)

FOREIGN PATENT DOCUMENTS

WO 2010012036 A1 2/2010

OTHER PUBLICATIONS

Perkins School for the Blind, Perkins Perspectives, Accessible prescription drug labels are coming, 4 pages.
(Continued)

*Primary Examiner* — Steven A. Reynolds
*Assistant Examiner* — Javier A Pagan
(74) *Attorney, Agent, or Firm* — Klintworth & Rozenblat IP LLC

(57) ABSTRACT

An auxiliary prescription label is provided for print-impaired individuals, such as blind and vision-impaired individuals. The auxiliary label is affixed to a prescription receptacle and does not permanently obscure the primary prescription label. The auxiliary label includes a book attached to a clip. The book is formed by a strip of printed material. The strip is folded to form the book and at least one stack of apertures is provided therethrough. The clip includes a base having at least one ear extending therefrom. The ear(s) are bent relative to the base to pass the ear(s) through the aperture(s), and the ear(s) are thereafter secured to the base. An adhesive secures the auxiliary label to the prescription receptacle.

20 Claims, 5 Drawing Sheets

(51) Int. Cl.
*B42D 3/18* (2006.01)
*B65D 25/20* (2006.01)

(56) References Cited

U.S. PATENT DOCUMENTS 4,300,848 A * 11/1981 Waegemann ..... B42F 13/42 3/42
6,360,462 B1 * 3/2002 Mengel ..... G09F 3/0289 40/306
6,401,304 B1 * 6/2002 Dossett ..... B65D 83/0088 24/16 PB
6,877,658 B2 4/2005 Raistrick et al.
7,061,831 B2 * 6/2006 De La Huerga ..... A61J 1/035 221/129
2009/0139066 A1 * 6/2009 Eriksson ..... E03C 1/33 24/318

OTHER PUBLICATIONS http://www.envisionamerica.com/products/scriptalk/scriptalk-station-for-patients, 6 pages.
http://www.walgreens.com/pharmacy/refillhub/refillhub_pres_settings.jsp?pageParam=lab, 1 page.
http://www.perkins.org/perspectives/briefs/coming-to-a-pharmacy-near-you.html, 2 pages.

* cited by examiner

AUXILIARY PRESCRIPTION LABEL

This application is a continuation-in-part application of Ser. No. 13/943,222 filed on Jul. 16, 2013, the disclosure of which is herein incorporated by reference.

FIELD OF THE INVENTION

The present invention relates to a Braille and/or large print auxiliary prescription label for print-impaired individuals, such as blind and vision-impaired individuals.

BACKGROUND OF THE INVENTION

A prescription label contains extremely important information about a medication. Placing full pertinent labeling information onto medications is a critical part of a pharmacist's job. Because of possibility of error from misreading medication labels, ensuring that that individual has the ability to read these labels is coming further to the forefront in the minds of pharmacists.

Many states have legally mandated what information is to be placed on a prescription medication. In addition, because the sizes of prescription receptacles, including vials, bottles and boxes, most pharmacies have limited choices for prescription label sizes which range typically between 2"×3" and 2"×4". With these sizes of labels, coupled with the large amount of information on the label, the print size on those labels is required to be smaller and therefore can be more difficult to read for elderly and low vision people. Since placing auxiliary labels onto medications is commonplace, today's pharmacist could permanently affix a more accessible auxiliary label onto a prescription in either Braille or large print that allows the print-impaired individual a label that is more easily read, while not altering the standard print label that resides on the medication. Keeping the standard medication label is important since it contain details in a certain format that the pharmacy and pharmacist must maintain and comply with state regulations.

Placing Braille or large print (minimum of 18 point font) onto a prescription receptacle requires a large amount of space on the prescription receptacle. Some pharmacies are now placing special electronic audible labels onto the prescription receptacle for those that cannot read their medication due to sight impairments, illiteracy or other print impairments. These electronic labels typically only provide information in an audible format.

While many individuals may prefer an audible version of the label, many may prefer a less expensive large print or Braille label to identify the medication and get the pertinent information. A few pharmacies currently offer an option of an affixed prescription label as large print. But, these services typically only provide the drug name in large print (12 point to 18 point font). Some pharmacies may offer the individual a separate detachable large print sheet that provides the information, but this large print page is not affixed and can be easily separated from the prescription receptacles and therefore confused with other prescription label details.

There are Braille labels available as a clear overlay, adhesive label. Although these Braille labels allow for some information to be placed on the medication, since it is an overlay, the overlay is limited to the size of the current label (typically 2"×4" or 2"×3").

An auxiliary label is provided herein which provides improvements to existing labels, and which overcomes the disadvantages presented by the prior art. Other features and advantages will become apparent upon a reading of the attached specification, in combination with a study of the drawings.

SUMMARY OF THE INVENTION

An auxiliary prescription label is provided for print-impaired individuals, such as blind and vision-impaired individuals. The auxiliary prescription label is affixed to a prescription receptacle and does not permanently obscure the primary prescription label on the prescription receptacle. The auxiliary label includes a book attached to a clip. The book is formed by a strip of material having printing thereon. The strip of material is folded to form the book and the book has at least one stack of apertures therethrough. The clip includes a base having at least one ear extending from the base. The ear(s) can be bent relative to the base to pass the ear(s) through the aperture(s). The ear(s) are secured to the base. An adhesive secures the base to the prescription receptacle.

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DETAILED DESCRIPTION OF THE ILLUSTRATED EMBODIMENTS

Figure 2:
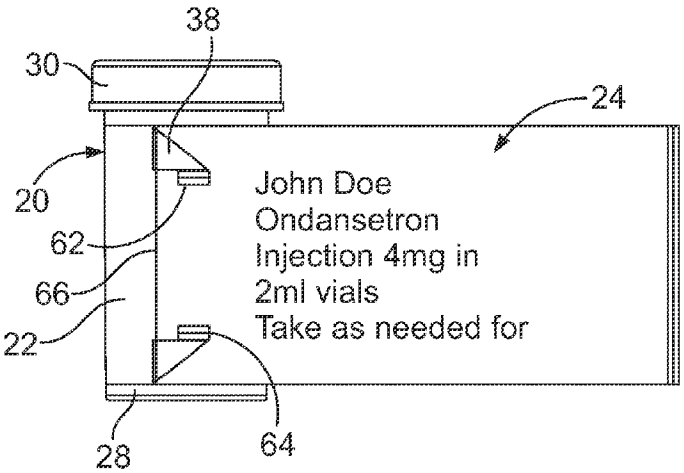
FIG. 2 is a bottom perspective view of the prescription receptacle, book and the first embodiment of the clip.

While the invention may be susceptible to embodiment in different forms, there is shown in the drawings, and herein will be described in detail, a specific embodiment with the understanding that the present disclosure is to be considered an exemplification of the principles of the invention, and is not intended to limit the invention to that as illustrated and described herein. Therefore, unless otherwise noted, features disclosed herein may be combined together to form additional combinations that were not otherwise shown for purposes of brevity.

Figure 1:
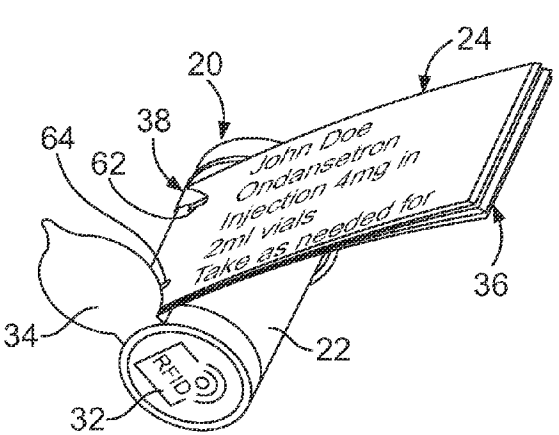
FIG. 1 is a side elevation view of an assembly including a prescription receptacle, a book and a first embodiment of a clip attaching the book to the prescription receptacle.
Figure 4:
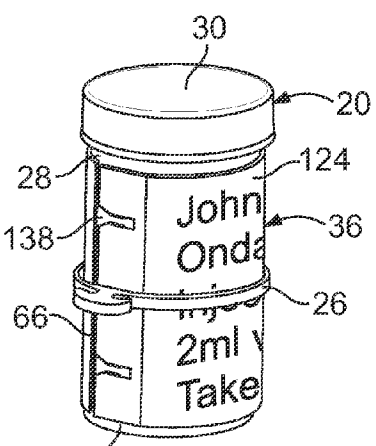
FIG. 4 is a perspective view of the prescription receptacle, book and a second embodiment of a clip, showing the book in a bound condition.
Figure 3:
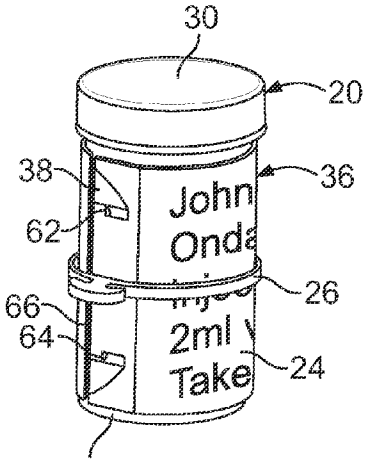
FIG. 3 is a perspective view of the prescription receptacle, book and the first embodiment of the clip, showing the book in a bound condition.
Figure 5:
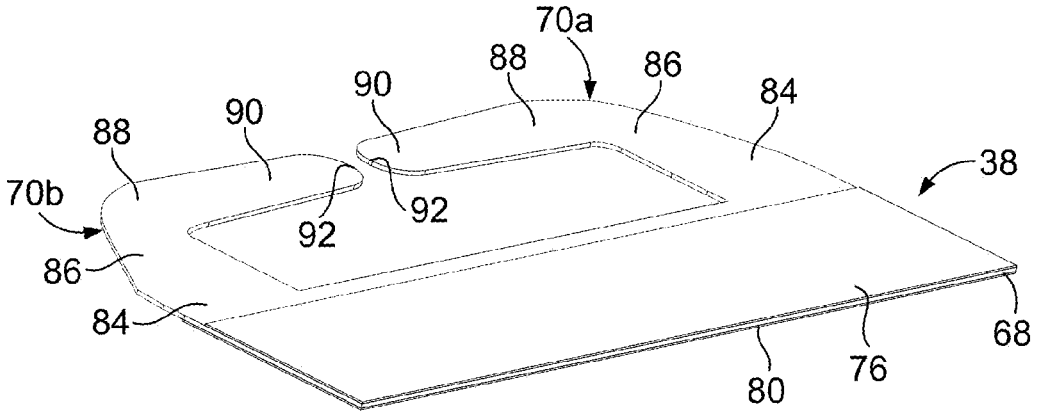
FIG. 5 is a perspective view of the first embodiment of the clip in an unfolded condition.

As shown in FIGS. 1, a prescription receptacle 20 has a primary prescription label 22 attached to the prescription receptacle 20, and an auxiliary prescription label 24, 124 attached to the prescription receptacle 20. The auxiliary prescription label 24, 124 overlays the primary prescription label 22, but the auxiliary prescription label 24, 124 can be easily lifted so that the primary prescription label 22 can be accessed and read. The auxiliary prescription label 24, 124 is read like a book and has Braille and/or large print (minimum of 18 point font) on both side of the folded pages. As shown in FIGS. 3 and 4, the auxiliary prescription label 24, 124 is bound to the prescription receptacle 20 by a removable fastener 26, such as a rubber band.

The prescription receptacle 20 can take many forms, for example but not limited to, vials, bottles and boxes. The prescription receptacle 20 has an open-ended body 28 which is closed by a lid or cap 30. As shown in the drawings, the prescription receptacle 20 is a bottle having a cylindrical side wall with an open upper end, a bottom wall closing the side wall, and a removable cap attached to the side wall for closing the upper end.

An RFID tag 32, as shown in FIG. 1, can be placed on the prescription receptacle 20. As shown, the RFID tag 32 is provided on the bottom wall of the body 28 and is covered by an adhesive label 34 to minimize damage to the RFID tag 32.

Figure 9:
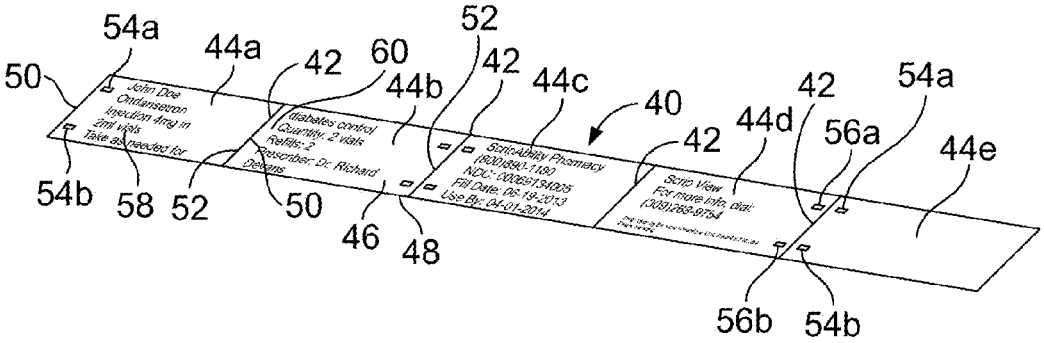
FIG. 9 is a perspective view of the book in an unfolded condition.
Figure 10:
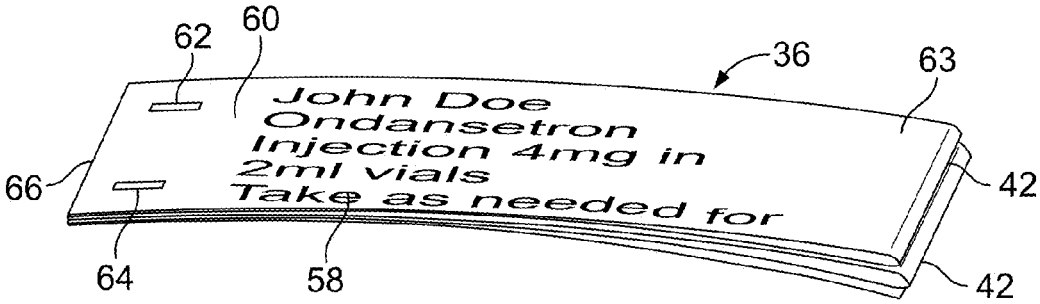
FIG. 10 is a perspective view of the book in a folded condition.
Figure 11:
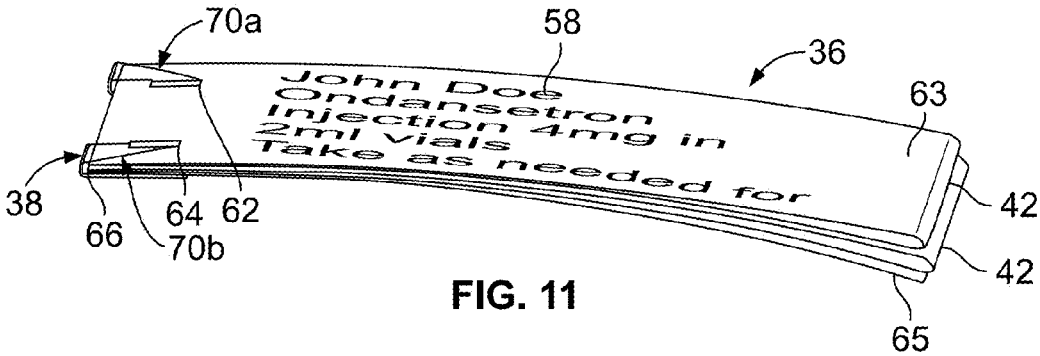
FIG. 11 is a perspective view of the book attached to the first embodiment of the clip.
Figure 12:
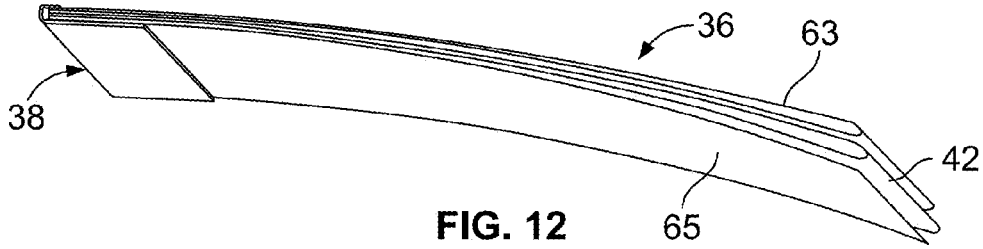
FIG. 12 is an alternate perspective view of the book attached to the first embodiment of the clip.
Figure 13:
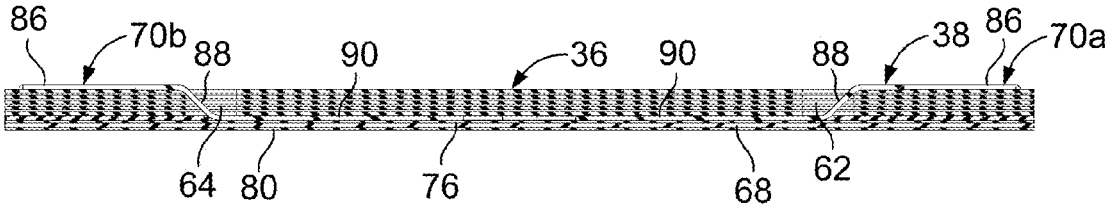
FIG. 13 is a cross-sectional view of the book and the first embodiment of the clip.

The auxiliary prescription label 24, 124 includes a book 36 and a clip 38, 138. As shown in FIGS. 9 and 10, the book 36 is formed of an elongated strip of material 40 that has a series of spaced apart lines 42, which can be formed by perforations or folds, along the length thereof that divides the strip of material 40 into individual sections 44*a*, 44*b*, 44*c*, 44*d*, 44*e* which are side-by-side. Each adjacent pair of sections 44*a* and 44*b*, 44*c* and 44*d* form a page in the book 36 and the rear page 65 can be formed by a single section, for example 44*e*, or can be formed by a pair of sections. The strip of material 40 can be formed of an inexpensive, continuous roll of non-adhesive label stock, or can be formed of other suitable material which can be printed on and folded. It is to be understood that when the term "printed", "print" or the like is used, that this means either Braille and/or words and/or numbers. The strip of material 40 has a front side 46 and a rear side 48. The strip of material 40 is folded along the lines 42 to form the individual pages, and when the strip of material 40 is completely folded, the book is formed. The lines 42 are spaced at predetermined intervals. Each individual section 44*a*, 44*b*, 44*c*, 44*d*, 44*e* defines a first end 50 and a second end 52. Along the series of sections 44*a*, 44*b*, 44*c*, 44*d*, 44*e*, each section which is an odd number (i.e., the first section 44*a*, the third section 44*c*, etc.) has a pair of spaced apart apertures 54*a*, 54*b* at the first end 50 of each such section; along the series of sections 44*a*, 44*b*, 44*c*, 44*d*, 44*e*, each section which is an even number (i.e., the second section 44*b*, the fourth section 44*d*, etc.) has a pair of spaced apart apertures 56*a*, 56*b* at the second end 52 of each of such section.

The sections 44*a*, 44*b*, 44*c*, 44*d*, 44*e* are printed on either using Braille and/or large print 58, leaving an appropriate margin 60 proximate to the apertures 54*a*, 54*b*, 56*a*, 56*b*, by a standard printer. The print 58 can include the necessary information to the print-impaired individual, without permanently obscuring the legally required primary standard prescription label 22 that is placed on the prescription receptacle 20. In the auxiliary prescription label 24, 124, many details, such as patient name, drug name, dosage, instructions, prescription number, pharmacy phone number, or even images of the medication can be supplied by the pharmacy to the individual in easy-to-read Braille and/or large print.

To form the book 36, the strip of material 40 is folded along the lines 42 to form the pages, such that the rear sides 48 of the first and second sections 44*a*, 44*b* abut each other, the front sides 46 of the second and third sections 44*b*, 44*c* abut each other, the rear sides 48 of the third and fourth sections 44*c*, 44*d* abut each other, the front sides 50 of the fourth and fifth sections 44*d*, 44*e* abut each other, and so on (depending on the number of pages). That is, for each pair of sections along the strip, the adjacent pairs alternate having their front sides and rear sides abut each other to form the book 36. As a result, the pairs of apertures 54*a*, 56*a* align with each other along one side of the book to form a first stack 62 of apertures, the pairs of apertures 54*b*, 56*b* align with each other along one side of the book 36 to form a second stack 54 of apertures and a binding 66 is formed proximate to the stacks 62, 64. A front page 63 is thus formed by the book 36, and a rear page 65 is thus formed by the book 36.

As shown in FIGS. 5-8 and 13, a first embodiment of the clip 38 has a flat base 68, having opposite side surfaces and at least one edge, with a pair of spaced apart ears 70*a*, 70*b* extending from the edge of the base 68. As shown, the base 68 is rectangular with four edges, but the base 68 can take other shapes, such as circular. The base 68 and ears 70*a*, 70*b* are preferably formed from plastic that is somewhat rigid, but can be bent into a desired shape. The ears 70*a*, 70*b* can be bent relative to the base 68, and the base 68 can be bent relative to the prescription receptacle 20. A first adhesive strip 76 covered by a release paper covers the first surface of the base 68, and a second adhesive strip 80 covered by a release paper covers the second surface of the base 68. Each adhesive strip 76, 80 is covered by its release paper until ready for use.

Each ear 70*a*, 70*b* is generally L-shaped in an unfolded condition. In the unfolded condition, each ear 70*a*, 70*b* has a first portion 84 which extends outwardly from the edge of the base 68, a second portion 86 extending linearly from the first portion 84, a third portion 88 extending generally perpendicularly from the second portion 86, and a fourth portion 90 extending linearly from the third portion 88. Each fourth portion 90 terminates in a free end 92 which is preferably rounded, and the free ends 92 align with each other.

Figure 6:
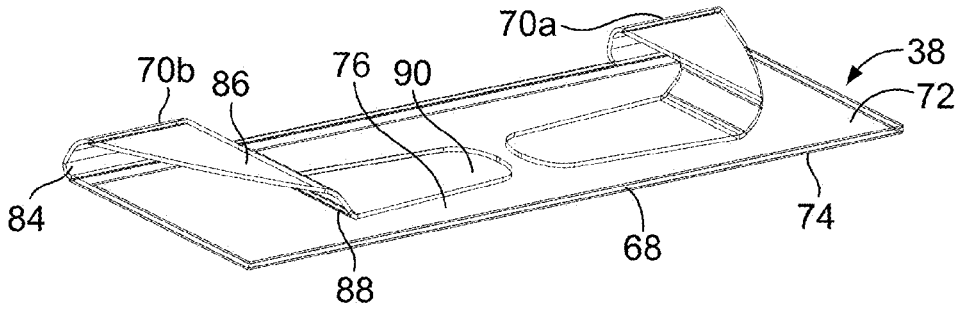
FIG. 6 is a perspective view of the first embodiment of the clip in a folded condition.
Figure 7:
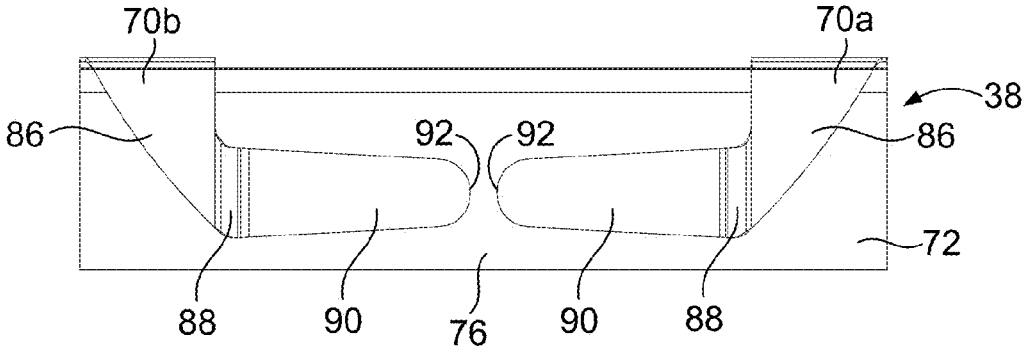
FIG. 7 is a top plan view the clip of FIG. 6.
Figure 8:
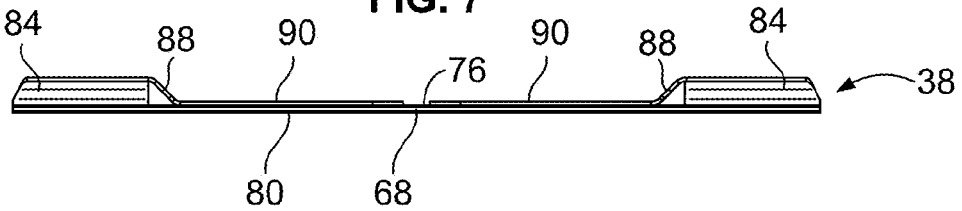
FIG. 8 is a side elevation view of the clip of FIG. 6.

In use, as shown in FIG. 6, the first portion 84 of each ear 70*a*, 70*b* is bent relative to the base 68 and relative to the second portion 86 to form an arc, so that the second, third and fourth portions 86, 88, 90 overlay the base 68. The third portion 88 in each ear 70*a*, 70*b* is bent relative to the second and fourth portions 86, 90 such that the second and fourth portions 86, 90 are parallel to each other in their final bent form.

The book 36 is assembled with the clip 38 by bending the third and fourth portions 88, 90 relative to the second portion 86 and inserting the ears 70*a*, 70*b* into a respective stack 62, 64 of aligned apertures in the book 36 by passing the fourth portion 90 of each ear 70*a*, 70*b* through the book 36. The ears 70*a*, 70*b* are first inserted through the front page 63 and move through the book 36 and exit out the rear page 65. The fourth portions 90 are then bent relative to the third portions 88 to be parallel to the second portions 86. As a result, the third portions 88 are seated within the stacks 62, 64 of aligned apertures in the book 36 and the first and second portions 84, 86 extend outwardly from the first page 63 of book 36. The fourth portions 90 engage the rear page 65 of the book to secure the book 36 with the clip 38 in this interim stage of assembly.

Next, the second portions 86 are bent relative to the third portions 88 to lay the second portions 86 against the front page 63 of the book 36. The first portions 84 are then bent relative to the second portions 86 to wrap the first portions 84 around the binding 66 of the book 36 and to position the base 68 parallel to the rear page 65 of the book 36. The fourth portions 90 have been bent relative to the third portions 88 to position the fourth portions 90 parallel to the rear page 65 of the book 36 and parallel to the base 68.

The book 36 and ears 70*a*, 70*b* are lifted away from the release paper of the first adhesive strip 76 and the release paper is removed from the first adhesive strip 76. The book 36 and ears 70*a*, 70*b* are then pressed against the first adhesive strip 76 to secure the book 36 and the clip 38 together and this forms the auxiliary prescription label 24. Thereafter, the release paper on the second adhesive strip 80 is removed and the auxiliary prescription label 24 is secured to the prescription receptacle 20 by pressing the auxiliary prescription label 24 against the prescription receptacle 20 which secures the base 68 to the prescription receptacle 20. The auxiliary prescription label 24 is assembled to the prescription receptacle 20 in such a manner that the primary prescription label 22 is not permanently obscured. The auxiliary prescription label 24 can overlay the primary prescription label 22, but the book 36 can be lifted away from the primary prescription label 22 so that the primary prescription label 22 can be read (the user removes the fastener 26 to access the book 36 and the primary prescription label 22). The user can turn the pages of the book 36 to read the information provided therein. Any number of desired pages can be provided in the book 36.

In this embodiment, the first adhesive strip 76 covered by a release paper can instead be provided on the fourth portions 90 of the ears 70*a*, 70*b* instead of on the first surface of the base 68 and removed to secure the ears 70*a*, 70*b* to the base 68.

Figure 14:
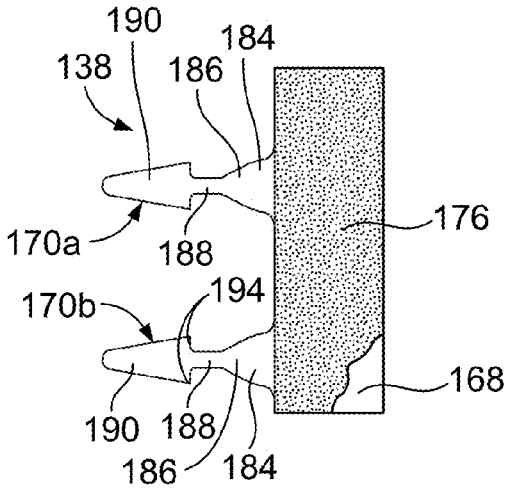
FIG. 14 is a top plan of a second embodiment of the clip in an unfolded condition.
Figure 15:
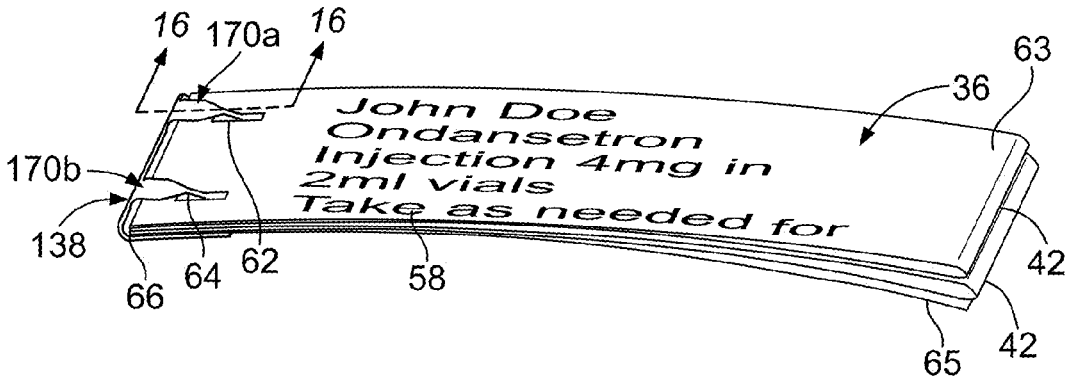
FIG. 15 is a perspective view of the book attached to the second embodiment of the clip.
Figure 16:
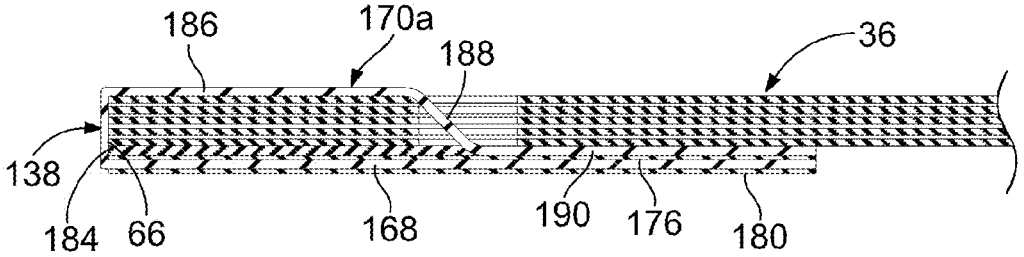
FIG. 16 is a cross-sectional view along line 16-16 of FIG. 15.

FIGS. 14-16 illustrate a second embodiment of the clip 138. The clip 138 has a flat base 168, having opposite side surfaces and at least one edge, with a pair of spaced apart ears 170*a*, 170*b* extending from the edge of the base 168. As shown, the base 168 is rectangular with four edges, but the base 168 can take other shapes, such as circular. The base 168 and ears 170*a*, 170*b* are preferably formed from plastic that is somewhat rigid, but can be bent into a desired shape. The ears 170*a*, 170*b* can be bent relative to the base 168, and the base 168 can be bent relative to the prescription receptacle 20. A first adhesive strip 176 covered by a release paper covers the first surface of the base 168, and a second adhesive strip 180 covered by a release paper covers the second surface of the base 168. Each adhesive strip 176, 180 is covered by its release paper until ready for use.

Each ear 170*a*, 170*b* is generally linear in an unfolded condition as shown in FIG. 14. In the unfolded condition, each ear 170*a*, 170*b* has a first portion 184 which extends outwardly from the edge of the base 168, a second portion 186 extending linearly outwardly from the first portion 184, a third portion 188 extending linearly outwardly from the second portion 186, and a fourth portion 190 extending linearly from the third portion 188. The third portion 188 forms a neck between the second and fourth portions 186, 190 and has a width which is less than the second and fourth portions 186, 190. Each fourth portion 190 is formed as a triangular barb having a pair of shoulders 194 extending outwardly from the third portion 188 and terminating in a free end 192 which is preferably rounded. The shoulders 194 are preferably wider than the stack 62, 64 of aligned apertures in the book 36.

In use, the first portion 184 of each ear 170*a*, 170*b* is bent relative to the base 168 and relative to the second portion 186 to form an arc, so that the second, third and fourth portions 186, 188, 190 overlay the base 168. The third portion 188 in each ear 170*a*, 170*b* is bent relative to the second and fourth portions 186, 190 such that the second and fourth portions 186, 190 are parallel to each other in their final bent form.

The book 36 is assembled with the clip 138 by inserting the ears 170*a*, 170*b* into a respective stack 62, 64 of aligned apertures in the book 36, and passing the fourth portion 190 of each ear 170*a*, 170*b* through the book 36. The ears 170*a*, 170*b* are first inserted through the front page 63 and move through the book 36 and exit out the rear page 65. The fourth portion 190 can deform as they are passed through the stacks 62, 64 of aligned apertures in the book 36, and upon exiting the stacks 62, 64 of aligned apertures in the book 36, the fourth portion 190 reassume their original shape. The shoulders 194 engage the rear page 65 of the book to secure the book 36 with the clip 138 in this interim stage of assembly. As a result, the third portions 188 are seated within the stacks 62, 64 of aligned apertures in the book 36 and the first and second portions 184, 186 extend outwardly from the first page 63 of book 36.

Next, the first portions 184 are bent relative to the second portions 186 to wrap the first portions 184 around the binding 66 of the book 36 and to position the base 168 parallel to the rear page 65 of the book 36. The fourth portions 190 are bent relative to the third portions 188 to position the fourth portions 190 parallel to the rear page 65 of the book 36 and parallel to the base 168.

The book 36 and ears 170*a*, 170*b* are lifted away from the release paper of the first adhesive strip 176 and the release paper is removed from the first adhesive strip 176. The book 36 and ears 170*a*, 170*b* are then pressed against the first adhesive strip 76 to secure the book 36 and the clip 138 together and this forms the auxiliary prescription label 124. Thereafter, the release paper on the second adhesive strip 180 is removed and the auxiliary prescription label 124 is secured to the prescription receptacle 20 by pressing the auxiliary prescription label 124 against the prescription receptacle 20 which secures the base 168 to the prescription receptacle 20. The auxiliary prescription label 124 is assembled to the prescription receptacle 20 in such a manner that the primary prescription label 22 is not permanently obscured. The auxiliary prescription label 124 can overlay the primary prescription label 22, but the book 36 can be lifted away from the primary prescription label 22 so that the primary prescription label 22 can be read (the user removes the fastener 26 to access the book 36 and the primary prescription label 22). The user can turn the pages of the book 36 to read the information provided therein. Any number of desired pages can be provided in the book 36.

In this embodiment, the first adhesive strip 176 covered by a release paper can instead be provided on the fourth portions 190 of the ears 170*a*, 170*b* instead of on the first surface of the base 168 and removed to secure the ears 170*a*, 170*b* to the base 168.

Figure 17:
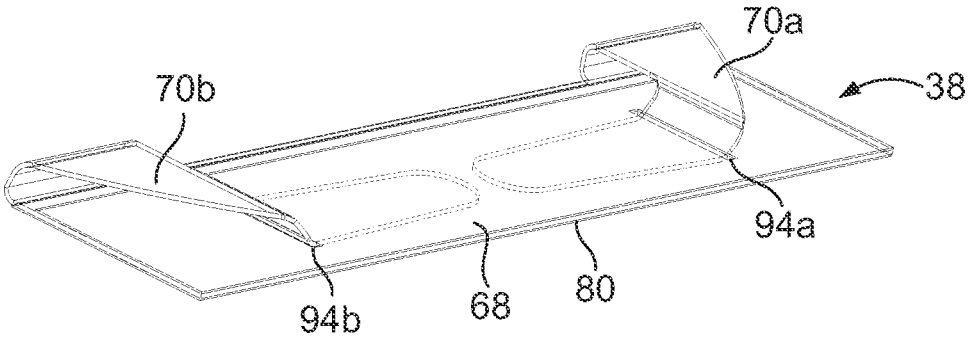
FIGS. 17-19 are perspective views of alternate embodiments of the clip.
Figure 18:
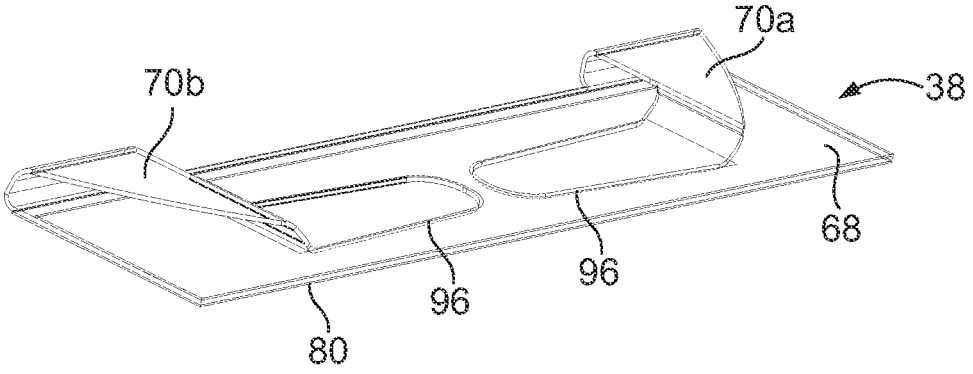
Figure 19:
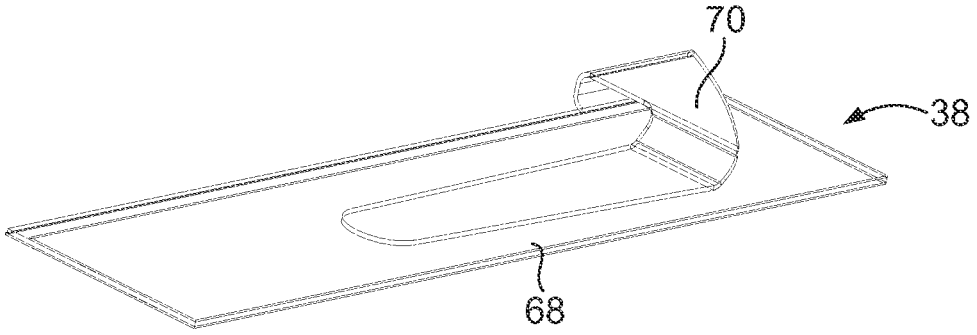

FIGS. 17-19 show alternate embodiments. These alternate embodiments are shown with regard to the clip 38, but it is to be understood that the clip 138 could instead be provided.

As shown in FIG. 17, the first adhesive strip 76 and its release paper have been eliminated and instead, a pair of apertures 94*a*, 94*b* are provided through the base 68 which align with the stacks 62, 64. The book 36 is assembled with the clip 38 by laying the rear page 65 of the book 36 on the first adhesive strip 76. The ear 70*a*, 70*b* is inserted into a respective stack 62, 64 as described above, and the fourth portions 90 (the third portions 188 in the second embodiment) passes through the respective aperture 94*a*, 94*b* in the base 68 and lays against the adhesive strip 80. Thereafter, the release paper on the second adhesive strip 80 is removed. The auxiliary prescription label 24 is secured to the prescription receptacle 20 by pressing the auxiliary prescription label 24 against the prescription receptacle 20 which secures the ears 70*a*, 70*b* to the second surface of the base 68, and secures the base 68 to the prescription receptacle 20.

Another alternative, shown in FIG. 18, is that the first adhesive strip 76 and its release paper are instead provided on fourth portions 90 (the third portions 188 in the second embodiment) and an aperture or pair of apertures 96 are provided in the base 68 which are the same size or slightly larger than the fourth portions 90 (the third portions 188 in the second embodiment). The fourth portions 90 (the third portions 188 in the second embodiment) seats within the aperture(s) 96 in the base 68. Thereafter, the release paper on the adhesive strips 76 on the fourth portions 90 (the third portions 188 in the second embodiment) and the release paper on the second adhesive strip 80 are removed. The auxiliary prescription label 24 is secured to the prescription receptacle 20 by pressing the auxiliary prescription label 24 against the prescription receptacle 20 which secures the fourth portions 90 (the third portions 188 in the second embodiment) and the base 68 to the prescription receptacle 20.

Yet another alternative is that only one ear 70, shown in FIG. 19, is provided and one stack of apertures (for example stack 62) are provided through the book 36. The ear 70 is attached to the book 36 in one of the ways set forth herein. The ear 70 can be centered or offset along the book 26.

Yet a further alternative is that two ears 70*a*, 70*b*, 170*a*, 170*b* are provided and only one stack of apertures is provided through the book 36. The two ears 70*a*, 70*b*, 170*a*, 170*b* seat through the single aperture and are attached to the book 36 in one of the ways set forth herein.

The auxiliary prescription label 24, 124 is easy-to-use and inexpensive for a pharmacy to provide Braille and/or large print thereon. The front page 63 of the auxiliary prescription label 24, 124 remains prominent and freely readable. The auxiliary prescription label 24, 124 maintains the integrity and readability of the legal, state-regulated primary prescription label 22 that pharmacies place on medications.

While preferred embodiments of the present invention are shown and described, it is envisioned that those skilled in the art may devise various modifications of the present invention without departing from the spirit and scope of the appended claims.

What is claimed is:

1. An assembly comprising:

a clip comprising a base having a first surface and a second surface, and an ear extending from said first surface of said base, the ear configured to be to positioned in a first unfolded condition and in a second folded position relative to the base, wherein when the clip is in the first unfolded position, the ear comprises a first portion attached to and extending outwardly from the base, a second portion attached to and extending from the first portion, a third portion attached to and extending from the second portion, and a fourth portion attached to and extending from the third portion, wherein when the clip is in the second folded condition, the first portion is bent to extend generally perpendicularly from the base, the second portion is bent to extend generally perpendicularly to the first portion and generally parallel to the base, the third portion is bent to extend at an angle relative to the second portion, and the fourth portion is bent to extend at an angle relative to the third portion, wherein in the second folded condition the fourth portion is parallel to the base and engages against the base;

and a book having printing thereon, said book having a front page, a rear page, a binding, and a stack of apertures extending therethrough from the front page to the rear page of the book, wherein when the clip is attached to the book, the base is proximate to the rear page of the book, the first portion is proximate to the binding, the second portion is proximate to the front page, the third portion extends through said stack of apertures and the fourth portion is engaged against said base.

2. The assembly of claim 1, wherein said fourth portion is formed as a barb having a width which is greater than a width of the stack of apertures.

3. The assembly of claim 1, wherein the fourth portion is secured to said base by adhesive.

4. The assembly of claim 1, wherein the third portion extends through said base.

5. The assembly of claim 4, wherein the third portion seats within an aperture in said base which is larger than the third portion, the fourth portion being secured to the base by adhesive.

6. The assembly of claim 1, wherein the third portion is linearly aligned with the second portion in the first unfolded condition.

7. The assembly of claim 1, wherein the third portion is generally perpendicular to the second portion in the first unfolded condition.

8. The assembly of claim 1, wherein the book is formed by a strip of material having printing thereon, the strip of material is folded to form the book.

9. The assembly of claim 1, wherein two of the ears are provided on the base and are spaced apart from each other.

10. The assembly of claim 1, further comprising an adhesive is provided on the bottom surface of the base.

11. A prescription receptacle comprising:

an open-ended body;

a cap covering said open end of said body;

a primary prescription label secured to said body; and an auxiliary prescription label comprising a clip and a book, said clip comprising a base having a first surface and a second surface, an ear extending from said first surface of said base, the ear configured to be to positioned in a first unfolded condition and in a second folded position relative to the base, wherein when the clip is in the first unfolded position, the ear comprises a first portion attached to and extending outwardly from the base, a second portion attached to and extending from the first portion, a third portion attached to and extending from the second portion, and a fourth portion attached to and extending from the third portion, wherein when the clip is in the second folded condition, the first portion is bent to extend generally perpendicularly from the base, the second portion is bent to extend generally perpendicularly to the first portion and generally parallel to the base, the third portion is bent to extend at an angle relative to the second portion, and the fourth portion is bent to extend at an angle relative to the third portion, wherein in the second folded condition the fourth portion is parallel to the base and engages against the base, and an adhesive provided on said bottom surface of said base, said book having printing thereon, said book having a front page, a rear page, a binding, and a stack of apertures extending therethrough from the front page to the rear page of the book, wherein when the clip is attached to the book, the base is proximate to the rear page of the book, the first portion is proximate to the binding, the second portion is proximate to the front page, the third portion extends through said stack of apertures and the fourth portion is engaged against said base, wherein said adhesive secures said auxiliary prescription label to said body and does not permanently obscure said primary prescription label.

12. The prescription receptacle of claim 11, wherein said fourth portion is formed as a barb having a width which is greater than a width of the stack of apertures.

13. The prescription receptacle of claim 11, wherein the fourth portion is secured to said base by adhesive.

14. The prescription receptacle of claim 11, wherein the third portion extends through said base.

15. The prescription receptacle of claim 14, wherein the third portion seats within an aperture in said base which is larger than the third portion, the fourth portion being secured to the base by adhesive.

16. The prescription receptacle of claim 11, further including an RFID tag provided on said body.

17. The prescription receptacle of claim 11, wherein the third portion is linearly aligned with the second portion in the first unfolded condition.

18. The prescription receptacle of claim 11, wherein the third portion is generally perpendicular to the second portion in the first unfolded condition.

19. The prescription receptacle of claim 11, wherein the book is formed by a strip of material having printing thereon, the strip of material is folded to form the book.

20. The prescription receptacle of claim 11, wherein two of the ears are provided on the base and are spaced apart from each other.

* * * * *